United States Patent [19]

Vice

[11] 4,008,934

[45] Feb. 22, 1977

[54] CHILD PROOF CABINET

[76] Inventor: George A. Vice, 105C E. Crooked Hill, Pearl River, N.Y. 10965

[22] Filed: Feb. 25, 1976

[21] Appl. No.: 661,369

[52] U.S. Cl. ..... 312/209; 312/244; 312/292

[51] Int. Cl.[2] ..... A47B 81/00; A47B 95/02; A47B 97/00

[58] Field of Search ..... 312/209, 212, 211, 213, 312/244, 290, 292, 306

[56] References Cited

UNITED STATES PATENTS

| | | | |
|---|---|---|---|
| 2,190,498 | 2/1940 | Williams | 312/244 |
| 2,239,128 | 4/1941 | Sykes | 312/244 |
| 2,906,407 | 9/1959 | France | 312/244 X |
| 2,948,433 | 8/1960 | Fineo | 312/244 |
| 3,052,508 | 9/1962 | Fink | 312/213 |
| 3,250,283 | 5/1966 | Reinfeld | 312/213 X |
| 3,872,342 | 3/1975 | Dankert | 312/212 |

*Primary Examiner*—Paul R. Gilliam
*Assistant Examiner*—K. Downey
*Attorney, Agent, or Firm*—Philip D. Amins

[57] ABSTRACT

This disclosure pertains to a cabinet for kitchens, bathrooms, and laundry rooms having a door hingably secured to the uppermost lateral surface of the cabinet. The hinge is located parallel and adjacent to the frontmost edge of the cabinet requiring the user to pivot the door upwardly and forwardly thus minimizing the ease of access to the storage area of the cabinet by children, preventing thereby tampering with dangerous household chemicals. A rigid perforated plastic liner is stored within the cabinet and is utilized to contain the articles to be stored within the cabinet and for convenient removal therefrom. A recessed handle is provided to facilitate opening the cabinet door as are two hand grasping areas for removing the plastic liner from within the cabinet by lifting the liner through the opened doorway.

17 Claims, 3 Drawing Figures

CHILD PROOF CABINET

BACKGROUND OF THE INVENTION

1. The Field of the Invention

This invention relates to cabinets for use in kitchens, bathrooms, and laundry rooms, and more specifically to that class having a single door opening from the top.

2. Description of the Prior Art

The prior art includes a wide variety of storage cabinets having diverse constructional details dependent upon the mode and location of use. Most cabinets employ a lateral horizontal work surface disposed on the topmost portion thereof and include, in many instances, doors, drawers, or access panels located in the front or sides other than the rear wall located adjacent a wall. Those cabinets which include a top access door, such as the variety utilized to house a dishwasher, hingably secure the top loading door adjacent the rear portion of the uppermost work surface. Thus, young children can gain access to the interior confines of the cabinet and are exposed to the hazard of ingesting dangerous household chemicals and cleaning materials as well as running the risk of having portions of their bodies, including their eyes, injured thereby.

SUMMARY OF THE INVENTION

A primary object of the present invention is to provide a cabinet enclosure which can only be opened from a horizontal work surface by adults, precluding access by children thereinto.

Another object is to provide a storage liner which promotes the easy removal of stored materials from within the cabinet.

Still another object is to provide a cabinet construction having a conventional work surface utilized as the sole accessway to the interior confines thereof.

Yet another object is to provide an access door which hingably opens from the top of the cabinet precluding the unauthorized accessibility by children therethrough whose hand reach is normally limited away from the rearmost edge of the door panel.

A further object is to provide a plastic liner having ventilation openings therethrough facilitating air circulation and minimizing weight.

Another object is to provide a cabinet construction compatable with the appearance and overall dimensions of existing cabinets that is child proof.

Most kitchen, bathroom, and laundry room cabinets have standard height and depth dimensions and include, in most cases, wearproof work surfaces. The instant invention describes a child proof cabinet whose outer appearance may be made to harmonize both in size and other physical characteristics with existing cabinets and may include a rear splash board. The handle, used to open the door hingably affixed to the work surface, is disposed inwardly and away from the front of the cabinet precluding easy access by children. The hinge is affixed to the back portion of the door and may be of the flush mounted variety. The uppermost surface of the door is flush with the work surface. The handle recesses below the door.

A plastic liner is provided, having a size compatable with passing through the door opening and is adapted with a plurality of openings disposed in the walls thereof and located a minimum distance from the floor of the cabinet allowing for ventilation and protecting the interior of the cabinet against inadvertant spillage of the materials stored within the liner.

In order to gain access to the household chemicals and cleaning compounds, a child would have to perform the task of reaching beyond the frontmost edge of the work surface, opening the door upwardly and frontwardly to minimally a vertical position and then, reach around the upwardly extending door into the cabinet in order to lift the liner upwardly through the door opening. This operation which can be easily performed by adults is virtually impossible for children.

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a cabinet enclosure, either of unitary construction or an integral part of a kitchen cabinet assembly. The cabinet includes four wall members, disposed at right angles to each other, supported by a recessed support stand. The rearmost wall member, adapted for placement against a wall of the room containing the cabinet, extends upwardly from the lateral horizontal work surface atop the cabinet and is utilized as a splash board. The work surface includes a door panel whose uppermost surface lies in a common plane with the work surface and is hingably affixed thereto, utilizing a flush mounted hinge located adjacent the wall opposite the rearmost wall. The door panel is adapted with a recessable handle located within the door adjacent the marginal edge opposite the hinge. The three sides of the door, other than the side bearing the hinge, taper downwardly and inwardly providing a supporting surface for the door by the oppositely directed edges of the door opening.

A plastic liner whose depth and width is less than the depth and width of the door opening is included within the cabinet and rests on the floor thereof. The liner has a plurality of openings in the walls thereof, including a pair of hand grasping openings located near the open top portion. The floor and a portion of the walls adjacent thereto are devoid of openings serving as a basin to retain accidental spilled household chemicals and detergents therein.

When the present invention is utilized as an integral part of an overall cabinet assembly, all of the aforementioned features are retained excepting the work surface being a part of the assembly work surface as may be the front and rear walls. Additionally, and supporting base may be modified to harmonize with the appearance and constructional details of the balance of the integral cabinet assembly.

Figure 1:
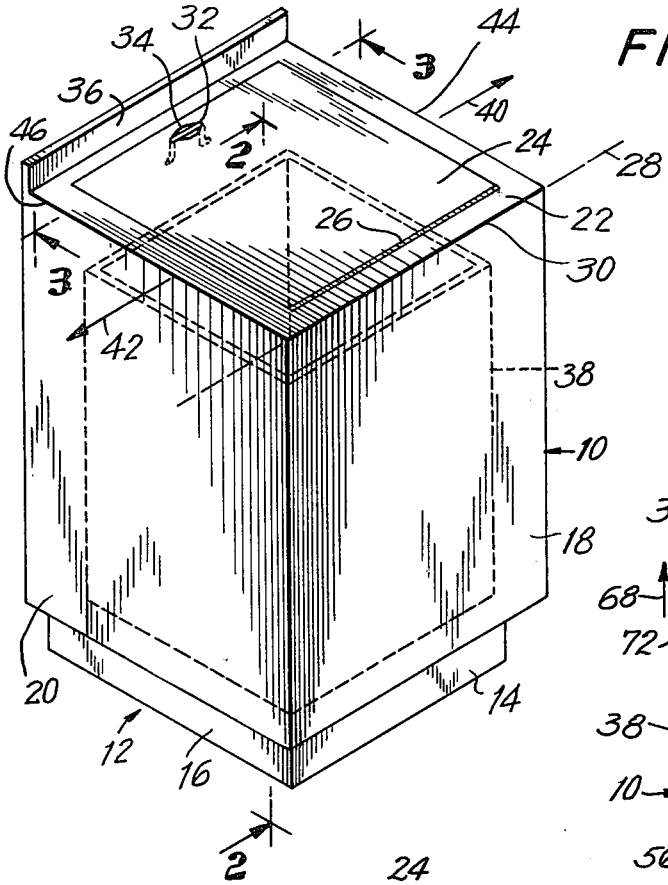
FIG. 1 is a perspective view of the present invention.

Now referring to the Figures, and more particularly to the embodiment illustrated in FIG. 1 showing rectangular cabinet 10 supported on base 12. The frontmost surface 14 and the side surface 16 of the base is shown recessed inwardly from the frontmost wall 18 and the side wall 20 of the cabinet providing a toe space. The uppermost work surface 22 includes a rectangular door panel 24, residing in a rectangular opening therein, utilizing recessed piano hinge 26 to hingably secure the door panel to the cabinet work surface 22 along a pivot line 28, which is parallel and adjacent to the frontmost uppermost edge 30 of the cabinet. Door panel handle 32 is recessed in the resting position, so as not to protrude above the uppermost surface of door panel 24 utilizing a finger opening 34 therefor. Splash panel 36 extends upwardly from work surface 22 and is located at the rear of the cabinet. Dotted lines 38 depict a container resting on the interior lateral horizontal surface 53 of cabinet 10 and having a dimensional outline consistant with convenient passage through the opening formed by hinging door panel 24 upwardly and frontwardly.

Work surface 22 may, if desired, extend in the direction of arrow 40 or arrow 42 or both when cabinet 10 in an integral part of a unitary multipurpose cabinet. In like fashion, splash panel 36 may also extend in the direction of arrow 40 or arrow 42 or both. The covering utilized as the work surface 22 need not be delineated from an adjacent co-extensive work surface, when employed, thereby permitting edge 44 or edge 46 to become unapparent, providing a smooth continuous work surface throughout. Surface 14, in like fashion, may extend in the direction of arrow 40 or arrow 42 or both, providing thereby a continuous unitary appearance to the kick plate feature formed thereby.

Figure 2:
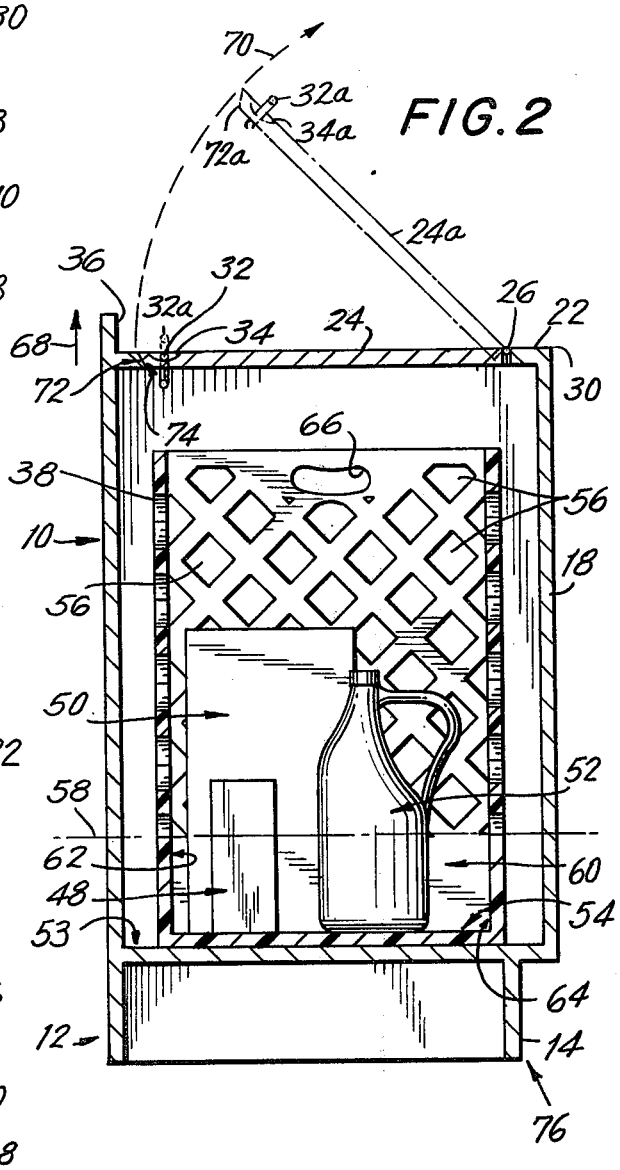
FIG. 2 is a cross-sectional side elevation view taken along line 2—2 viewed in the direction of arrows 2—2 as shown in FIG. 1 illustrating the cabinet, removable liner, and the container stored therewithin.

FIG. 2 is a cutaway view of the side elevation of the cabinet 10 and the interior container 38, shown in FIG. 1, resting on horizontal surface 53 in the interior of cabinet 10. Boxes 48 and 50 and bottle 52 are shown resting on the floor 54 of container 38. Perforations 56 permit the interior of container 38 to be vented and are located above line 58, parallel to floor 54, delineating unperforated wall areas 60, 62, and 64 of container 38. The cutaway portions of the container 38, below line 58, are similarly unperforated, providing thereby, for a catch basin for any of the chemicals, detergents, and the like, not shown, which might inadvertantly spill from boxes 48, 50, and bottle 52 or other vessels, not shown, housed within container 38. Elongated cutout portion 66 provides a hand grip for removal of container 38, when lifted upwardly in the direction of arrow 68 after door 24 has been pivoted about hinge 26, towards front wall 18, in the direction of dotted arrow 70. In order to remove container 38, the adult user grasps handle 32, lifting it upwardly to an extended location, shown in dotted lines **32*a*, and exerts a force parallel to the direction of arrow 70, causing door panel 24 to move upwardly and forwardly into a position shown in dotted lines 24*a*. The rearmost edge 72 of door panel 24, depicted as numerals 72*a*, in dotted lines, when door panel 24*a*, in dotted lines, is shown in the open position, is tapered downwardly and inwardly so as to be provided a mating supporting edge surface 74 located adjacent work surface 22 surrounding the door panel 24 on all of the sides thereof exclusive of the side bearing the flush hinge 26. Kick plate surface 14 is recessed inwardly from front wall 18 providing a toe space 76** thereby.

Figure 3:
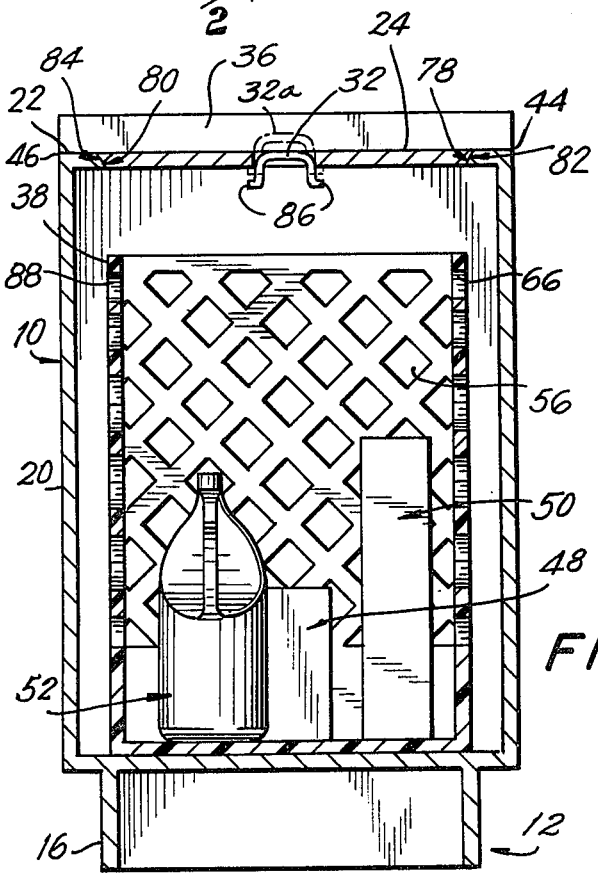
FIG. 3 is a cross-sectional front elevational view taken along line 3—3 viewed in the direction of arrows 3—3 as shown in FIG. 1 illustrating the cabinet, removable liner, and the container stored therewithin.

FIG. 3 illustrates a cutaway portion of cabinet 10 and container 38, as viewed from the front of the cabinet. Splash panel 36 extends upwardly from work surface 22 and door panel 24. Edges 78 and 80, of door panel 24, are shown resting upon mating edges 82 and 84. Edges 82 and 84, in conjunction with edge 74, as shown in FIG. 2, and line 28, as shown in FIG. 1, define the door opening in which door panel 24 resides when closed. Handle 32 is adapted with wings 86 which engage the lowermost surface of door panel 24 when handle 32 is manually lifted upwardly in the position illustrated by dotted lines **32*a*. The horizontal portion of handle 32 is confined within recess 34, shown in FIG. 2, at times that the handle is in the lowermost position. Opening 88 is a companion hand grasping opening to opening 66 located in the opposed side wall of container 38.**

One of the advantages is a cabinet enclosure which can only be opened from a horizontal work surface by adults, precluding access by children thereinto.

Another advantage is a cabinet construction providing a storage liner which promotes the easy removal of stored materials from within the cabinet.

Still another advantage is a cabinet construction having a conventional work surface utilized as the sole accessway to the interior confines thereof.

Yet another advantage is an access door which hingably opens from the top of the cabinet precluding the unauthorized accessibility by children therethrough whose hand reach is normally limited away from the rearmost edge of the door panel.

A further advantage is a plastic liner having ventilation openings therethrough facilitating air circulation and minimizing weight.

Another advantage is a cabinet construction compatable with the appearance and overall dimensions of existing cabinets that is child proof.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited not by the specific disclosure herein, but only by the appending claims.

The embodiment of the invention in which an exclusive privilege or property is claimed are defined as follows:

1. A cabinet comprising an enclosure,
said enclosure having a rearmost vertical wall,
a door panel,
a surface of said enclosure being disposed in a horizontal plane,
an opening being disposed in said surface,
hinging means hingably securing said door panel adjacent said opening,
a substantially integrally formed frontmost wall
said hinging means being disposed in spaced adjacent relationship to said frontmost wall,
handle means for manually manipulating said door panel,
said handle means being disposed on said door panel adjacent a marginal edge thereof,
said marginal edge being disposed in spaced adjacent relationship to said rearmost vertical wall,
a hollow container having an open mouth portion disposed at one end thereof,
said door panel being capable of pivotal movement with respect to said hinge means for effectively covering and uncovering said opening, said hollow container including hand grasping means disposed adjacent said container open mouth portion for manually lifting said container upwardly through said opening when said door panel uncovers said opening, a supporting surface being disposed within said enclosure, and said container being supported by said supporting surface when positioned within said enclosure.

2. The cabinet in accordance with claim 1, wherein said enclosure includes a pair of side walls disposed in spaced apart relationship and extends between said rearmost vertical wall and said frontmost wall.

3. The cabinet in accordance with claim 2, wherein said horizontal surface is bounded by said rearmost vertical wall and said pair of side walls.

4. The cabinet in accordance with claim 2, wherein said horizontal surface is bounded by said rearmost vertical wall and said pair of side walls and said frontmost wall.

5. The cabinet in accordance with claim 1, further comprising a plate, said plate extending upwardly from said horizontal surface, and said plate being disposed in adjacent relationship to said rearmost vertical wall.

6. The cabinet in accordance with claim 1, wherein said door panel includes an outermost lateral surface, said outermost lateral surface being disposed in said horizontal plane when said door panel is disposed in covering relationship to said opening.

7. The cabinet in accordance with claim 1, wherein said hinging means comprises a hinge having one side thereof fixedly secured to said opening, and the other side of said hinge being fixedly secured to said door panel.

8. The cabinet in accordance with claim 7, wherein said hinge is disposed below said surface.

9. The cabinet in accordance with claim 1, wherein said handle means is positioned below said surface.

10. The cabinet in accordance with claim 6, wherein said handle means comprises a recess formed in said outermost lateral surface of said door panel, a pair of holes being disposed within said recess in spaced apart relationship, a handle, said handle having an inverted U-shaped cross-section and including a wing and a pair of legs, each of said legs of said inverted U-shaped cross-section passing through a corresponding one of said pair of holes, and said wing being fixedly secured to one of the ends of each of said legs, and extending radially outwardly therefrom.

11. The cabinet in accordance with claim 1, wherein said opening comprises four marginal edges, each of said four marginal edges being disposed at right angles to adjacent ones of said marginal edges of said opening, the first of said marginal edges being disposed intermediate said hinge means and said rearmost vertical wall, two of said marginal edges being disposed adjacent said first marginal edge, said two of said marginal edges and said first marginal edge being disposed at an acute angle directed inwardly and downwardly from said horizontal surface, and said door panel having each of three marginal edges thereof co-planar with the mating surfaces of said first marginal edge and said two of said marginal edges of said opening when said door panel is disposed in covering relationship to said opening.

12. The cabinet in accordance with claim 1, wherein said container further comprises a floor, and a plurality of holes being disposed in the walls of said container adjacent said open mouth portion.

13. The cabinet in accordance with claim 12, wherein said plurality of holes are formed in the walls of said container which is intermediate said open mouth portion and a reference plane, said reference plane being parallel to said floor, and said reference plane being disposed intermediate said floor and said open mouth portion of said container.

14. The cabinet in accordance with claim 1, wherein said hand grasping means comprises at least one elongated opening formed in at least one of the walls of said container, and said elongated opening extending substantially parallel to said open mouth portion.

15. The cabinet in accordance with claim 2, further comprising a supporting base for supporting said enclosure, said supporting base having a front vertical wall, which is disposed intermediate said rearmost and frontmost vertical walls of said enclosure.

16. The cabinet in accordance with claim 15, wherein said supporting base further comprises a pair of vertical side walls, and said pair of vertical side walls being disposed in spaced apart parallel relationship and recessed inwardly with respect to said pair of side walls of said enclosure.

17. The cabinet in accordance with claim 1, wherein said enclosure comprises a substantially unitary construction, said construction including a portion of said rearmost vertical wall and a portion of said frontmost wall extending outwardly from said enclosure, and a portion of said horizontal surface extending outwardly of said enclosure intermediate said portions of said frontmost and rearmost vertical walls.

* * * * *

UNITED STATES PATENT OFFICE

CERTIFICATE OF CORRECTION

Patent No. 4,008,934 Dated February 22, 1977

Inventor(s) George A. Vice

It is certified that error appears in the above-identified patent and that said Letters Patent are hereby corrected as shown below:

On the cover sheet, in item [76] "105C E. Crooked Hill" should read

-- 105 East Crooked Hill Road --

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*